US009328589B2

(12) United States Patent
Remy et al.

(10) Patent No.: US 9,328,589 B2
(45) Date of Patent: May 3, 2016

(54) APPARATUS FOR CONTROLLING INJECTION PRESSURE IN OFFSHORE ENHANCED OIL RECOVERY

(71) Applicant: S.P.C.M. SA, Andrezieux Boutheon (FR)

(72) Inventors: Pascal Remy, Saint Etienne (FR); Emmanuel Pich, Saint Priest en Jarez (FR)

(73) Assignee: S.P.C.M. SA, Andrexieux Boutheon (FR)

( * ) Notice: Subject to any disclaimer, the term of this patent is extended or adjusted under 35 U.S.C. 154(b) by 0 days.

(21) Appl. No.: 14/520,945

(22) Filed: Oct. 22, 2014

(65) Prior Publication Data

US 2015/0041143 A1 Feb. 12, 2015

(30) Foreign Application Priority Data

Oct. 1, 2014 (FR) ..... 14 59378

(51) Int. Cl.

| | |
|---|---|
| ***E21B 34/04*** | (2006.01) |
| ***E21B 43/01*** | (2006.01) |
| ***E21B 17/20*** | (2006.01) |
| ***E21B 19/00*** | (2006.01) |
| ***E21B 43/16*** | (2006.01) |
| ***E21B 43/20*** | (2006.01) |

(52) U.S. Cl.

CPC ..... *E21B 43/01* (2013.01); *E21B 17/20* (2013.01); *E21B 19/002* (2013.01); *E21B 34/04* (2013.01); *E21B 43/16* (2013.01); *E21B 43/20* (2013.01)

(58) Field of Classification Search

CPC ..... E21B 34/04; E21B 43/16; E21B 43/20
USPC ..... 166/345
See application file for complete search history.

(56) References Cited

U.S. PATENT DOCUMENTS

| | | | | |
|---|---|---|---|---|
| 6,268,911 | B1 * | 7/2001 | Tubel | E21B 23/03 250/256 |
| 6,281,489 | B1 * | 8/2001 | Tubel | E21B 47/00 166/250.15 |
| 6,633,236 | B2 * | 10/2003 | Vinegar | E21B 43/122 166/73 |
| 7,600,567 | B2 * | 10/2009 | Christopher | B01D 61/025 166/263 |
| 8,607,869 | B2 | 12/2013 | Soucy | |
| 2005/0023222 | A1 * | 2/2005 | Baillie | B01D 61/04 210/651 |
| 2007/0090039 | A1 * | 4/2007 | Young | B01D 61/04 210/321.6 |
| 2012/0292029 | A1 | 11/2012 | Soucy | |
| 2012/0312544 | A1 * | 12/2012 | Tavner | E21B 17/085 166/367 |
| 2014/0338921 | A1 * | 11/2014 | Barry | E21B 43/16 166/369 |
| 2015/0034570 | A1 * | 2/2015 | Andreussi | B01D 17/0214 210/801 |
| 2015/0107834 | A1 * | 4/2015 | Shen | E21B 43/305 166/272.3 |
| 2015/0122503 | A1 * | 5/2015 | Shilling | E21B 17/015 166/367 |

FOREIGN PATENT DOCUMENTS

| | | | |
|---|---|---|---|
| EP | 2203245 | B1 | 7/2010 |

* cited by examiner

*Primary Examiner* — Matthew R Buck
*Assistant Examiner* — Aaron Lembo
(74) *Attorney, Agent, or Firm* — St. Onge Steward Johnston & Reens, LLC

(57) ABSTRACT

An apparatus for controlling the injection pressure of an aqueous polymer solution in a subsea oil wellhead, includes a linear pressure reducer in the form of a tube connected in series to the main injection line that is capable of absorbing the majority of the pressure drop and a choke that is capable of being regulated in order to enable a pressure control between 0 and 10 bar. Also, a process of offshore enhanced oil recovery by injection of an aqueous polymer solution uses the apparatus.

14 Claims, 5 Drawing Sheets

APPARATUS FOR CONTROLLING INJECTION PRESSURE IN OFFSHORE ENHANCED OIL RECOVERY

FIELD OF THE INVENTION

The present invention concerns offshore enhanced oil recovery by injection of an aqueous polymer solution.

BACKGROUND OF THE INVENTION

Enhanced oil recovery (EOR) which was industrialized particularly in the United States between 1973, the date of the first oil crisis, and 1986, the date of the oil price collapse to 10 dollars a barrel, was put back on the agenda at the beginning of the 2000s decade when the price of oil exceeded 40 dollars a barrel. With a current cost of 100 dollars a barrel, enhanced oil recovery with the use of water-soluble polymers, which permits an additional 10% to 20% increase of the yield of the reserves in place, has become a choice technique.

However, its use in large oilfields comes up against certain technical problems which are gradually being solved.

One of the device that has enabled this development is the PSU (Polymer Slicing Unit) described in patent EP 2 203 245. These types of water-soluble polymers are very difficult to disperse due to a bonding and agglomerating effect that gives gels or "fish eyes" that take a long time to dissolve. These gels cannot be injected into the formations without damage. The PSU enables both an excellent dispersion and a high dissolution concentration reducing the sizes of the dissolution tanks and high-pressure pumps which constitute a significant part of the investments needed.

The second problem is the mechanical degradation of the polymer. Customarily, on an oilfield, a single water injection pump supplies several wells. But due to the heterogeneity of the fields, the injection pressures are different from one well to the next. For this, a control or pressure-regulating valve known as a choke is installed at the wellheads. The polymer solution cannot pass through this choke without a degradation that is practically proportional to the pressure drop. Roughly, a pressure drop of 20 bar will degrade the viscosity by the order of 20%. A pressure drop of 50 bar will degrade the viscosity by the order of 50%. Obviously, these degradations are dependent on the type of polymer, on the viscosity, on the concentration of the dissolution brine composition and on the temperature. Only pilot tests make it possible to predict the amplitude of the degradation.

In order to overcome this problem, various solutions have been used:

- Customarily, the stock solution prepared at a concentration of 10 to 20 g/liter is pumped by a high-pressure triplex pump at the wellhead, after the choke, before a static mixer. This system requires numerous pumps (one per well) and numerous pipelines, which increases the cost of the installation.
- Another solution is to create a solution at the final concentration (500 to 3000 ppm) and to inject it into each well by means of a linear pressure reducer as described in U.S. Pat. No. 8,607,869.

This linear pressure reducer is modular and makes it possible, using 3 to 6 lengths of tubes separated by 4-way valves, to regulate the pressure with an accuracy of 1 to 5 bar, it being possible to carry this out manually or by means of a programmable controller. It is in the form of a housing where the stainless steel tube windings may be activated or deactivated in order to obtain the required pressure.

From a technical point of view, the flow of a polymer solution in a tube does not cause any degradation or causes very little degradation of the polymer up to a certain speed that is dependent on the diameter of the tube, on the viscosity, on the salinity of the solution and which can be determined experimentally.

The pressure drop changes as a function of the flow speed of the polymer solution in the tube, and as a function of the flow rate as shown in FIGS. 1 and 2. In other words, the polymer is degraded to a greater or lesser extent as a function of the flow speed as shown in FIG. 3.

Customarily, the degradation depends on the speed and on the diameter of the tube. It is considered that a pressure drop of 1 bar over 10 meters leads to an acceptable degradation. However, due to the composition of the brine, the type and concentration of the polymer, and the temperature, prior tests make it possible to optimize the diameter and the length of the tube constituting a linear choke.

In the case mentioned in FIGS. 1 to 3, and for a given diameter of 1 inch, in order for the pressure drop to be less than or equal to 1 bar over 10 meters, the flow speed should not exceed 7.5 m/s approximately, and the flow rate should not exceed 13 $m^3$/h.

Customarily, standard chokes make it possible to control the pressure over a pressure drop range from 0 to 50 bar, which corresponds to the use of a linear pressure reducer of 500 meters approximately.

A linear pressure reducer as described in U.S. Pat. No. 8,607,869 functions very well when it is used at the surface since it is directly accessible for inspection and maintenance operations. The liquid, electric or hydraulic connections become extremely important when a high degree of reliability is required.

But this type of apparatus becomes very complex when it is desired to adapt it to subsea applications, in particular as regards the replacement of valves, of coils, of measurement apparatus, the inspection of the valve openings, the connections to the surface and the high maintenance, depending on the case, by divers or robots.

Extrapolated to a subsea installation, this type of apparatus leads to additional constraints inherent to its technology (control and measuring devices, confirmation of the openings of the valves, measurement of flow rate and pressure, modules that can be disconnected for maintenance, electrical housings, umbilicals, etc.).

SUMMARY OF THE INVENTION

The objective of the invention is therefore to simplify the system so as to give it the robustness and simplicity needed for subsea use.

Subsea production fields have an architecture that is quite different from terrestrial fields. They are processed from platforms or boats (FPSO) (FIG. 4). The policies for injection of water or solution of polymers are very different depending on the operating company.

The simplest process consists in having one injection tube (riser) per well. In this configuration, the dilution of the stock solution is carried out by injection into the high-pressure tube after the surface choke installed on the boat or platform. The diameter of these transport tubes is generally of the order of 10 inches, which does not generate a significant pressure drop.

But for more extensive fields, usually, each FPSO or platform lowers several risers to manifolds that distribute the flow over several wells by means of chokes for regulating the injection pressure for each well.

This system is totally disadvantageous for the polymer solutions since starting from a pressure drop in the choke of 10 to 15 bar, the polymers are significantly degraded. The loss of efficiency of the enhanced oil recovery process due to the degradation of the polymer before its injection into the well must then be compensated for by an increased concentration of polymer which, over operating periods of 5 to 10 years, represents an extremely high cost.

The invention consists in inserting, upstream or downstream of a choke, a pressure reducer in the form of a tube that makes it possible to absorb most of the pressure drop needed, the choke itself making it possible to adjust the pressure within the range between 0 and 10 bar, that is to say over a range that does not cause significant degradation of the polymer.

The combination of a pressure reducer, the dimensions of which may be calculated on the ground, with a choke, the role of which is to adjust the pressure without significantly degrading the polymer, makes it possible to solve the problem stated above. This makes it possible to limit the degradation of the polymer in a completely acceptable manner by reducing it to less than 10%. For example, on a well where the pressure reduction needed is of the order of 50 bar, the pressure reducer makes it possible to obtain a pressure drop of around 45 bar and the choke from 0 to 10 bar.

One subject of the invention is therefore an apparatus for controlling the injection pressure of an aqueous polymer solution in a subsea oil well, said apparatus being capable of being submerged and consisting of:

- a pressure reducer in the form of at least one tube intended to be inserted between two lengths of main injection line, the pressure reducer having a diameter less than that of the main line and being capable of absorbing the majority of the pressure drop;
- a choke positioned immediately upstream or downstream of the pressure reducer, said choke being capable of being regulated in order to enable a pressure control between 0 and 10 bar.

According to the invention, the pressure reducer is capable of absorbing at least 60% of the pressure drop, preferably at least 80%, more preferably at least 90%.

In one preferred embodiment, the tube of the pressure reducer comprises at least one flexible tube section, which makes it possible to be able to manipulate the tube more easily in an underwater environment during the installation thereof or maintenance thereof by divers or underwater robots.

The pressure reducer comprises one or more flexible tube sections connected end-to-end to one another and to the choke by quick couplings that allow easy attachment. Couplings referred to as quick couplings are well known to person skilled in the art since they make it possible to easily connect the components to one another, including under difficult handling conditions such as the underwater environment. They are also referred to as quick connection systems.

The flexible tubes are selected from all types of flexible pipes composed of plastic, rubber or composite. They preferably consist of a rubber-textile or metalloplastic composite capable of withstanding high pressures, at least equal to the pressure of the injection pump.

In one alternative embodiment, the linear pressure reducer comprises one or more rigid metallic tube sections connected in series to one another and to the choke directly or by means of flexible tubes. In this case, the rigid metallic tube section or sections are in a spirally wound form.

In practice, the metallic tubes are made of stainless steels, in particular of "super duplex" austenitic-ferritic steels or austenitic steels that are surface hardened (vacuum nitriding, Kolsterising) and that have a high mechanical strength and also a high corrosion resistance.

The pressure reducer is positioned downstream or upstream of the choke. The pressure control apparatus according to the invention is positioned downstream of the manifold.

The internal diameter of the tube is between ½ inch and 4 inches, preferably between ½ inch and 3 inches. This diameter is small compared to the internal diameter of the main injection line, which is of the order of 10 inches.

In other words, the pressure reduction in a tube having an internal diameter of the order of 10 inches is considered to be insignificant within the context of the invention, whereas the pressure reduction in a tube having a diameter between ½ inch and 4 inches is significant without however causing significant degradation of the polymer. This is because, in the main injection lines, the speed is of the order of 2 to 3 meters/second whereas it reaches 6 to 14 meters/second in the tube of the linear pressure reducer.

The length of tube constituting the pressure reducer is between 10 and 1000 meters, preferably between 50 and 600 meters.

Another subject of the invention is a process for reducing the polymer injection pressure as a function of the fracture pressure of the well using the apparatus described above in an offshore enhanced oil recovery process.

More specifically, the process according to invention comprises the following steps:

- calculating the pressure reduction needed by subtracting the wellhead injection pressure from the pressure of the main injection pump;
- determining, via ground tests, the dimensioning and nature of the constituent tube of the pressure reducer so that the pressure drop is equal to the pressure reduction needed minus that provided by the choke, this being under the conditions of injecting the aqueous polymer solution in situ;
- submerging then connecting the pressure reducer to the choke and inserting the pressure control apparatus thus obtained between two submerged lengths of injection line;
- injecting the aqueous polymer solution into the main line.

The term "dimensioning" is understood to mean the total length of the tube, the number of sections and the diameter of the tube section or sections. The term "nature" is understood to mean the tube section composition material or materials.

The pressure control apparatus according to invention is preferably positioned downstream of the manifold, before the choke.

During the operation, the pressure drop needed may vary.

In the process according to the invention, the pressure control may be carried out owing to the opening or closing of the choke controlled remotely from the platform or FPSO boat. It may also be carried out by increasing or reducing the length of the tube by the addition or removal of a tube section, owing to the intervention of divers or underwater robots. This handling is even easier because the tube section or sections are flexible and because quick couplings are used.

More specifically, the pressure control provided by the choke is between 0 and 10 bar, preferably between 1 and 5 bar.

A person skilled in the art will be able to adapt the apparatus and the process for each particular case.

The invention and the advantages that result therefrom will become very clear from the following examples, in support of the appended figures.

DETAILED DESCRIPTION OF THE INVENTION

Installation Example

Figure 1:
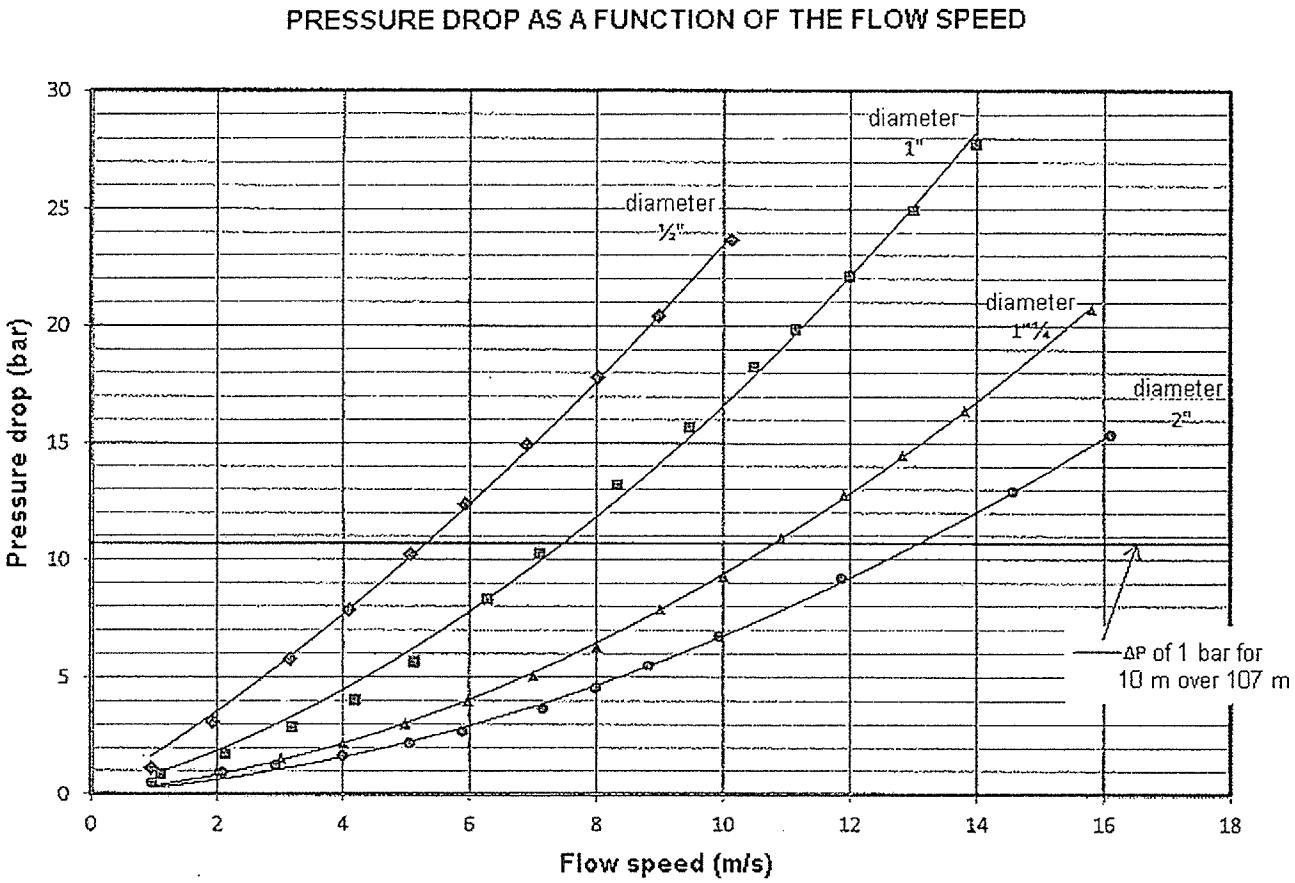
FIG. 1 is a curve representing, for a given polymer solution, the pressure drop as a function of the flow speed, in tubes having a length of 107 meters and a variable diameter (that varies from a half to two inches). The polymer solution contains 1000 ppm of an acrylamide/sodium acrylate copolymer (70/30 mol %) having a molecular weight of around 20 million g/mol dissolved in a brine containing 5 g/l of NaCl, 0.113 g/l of $MgSO_4$, and 0.096 g/l of $CaCl_2$.
Figure 2:
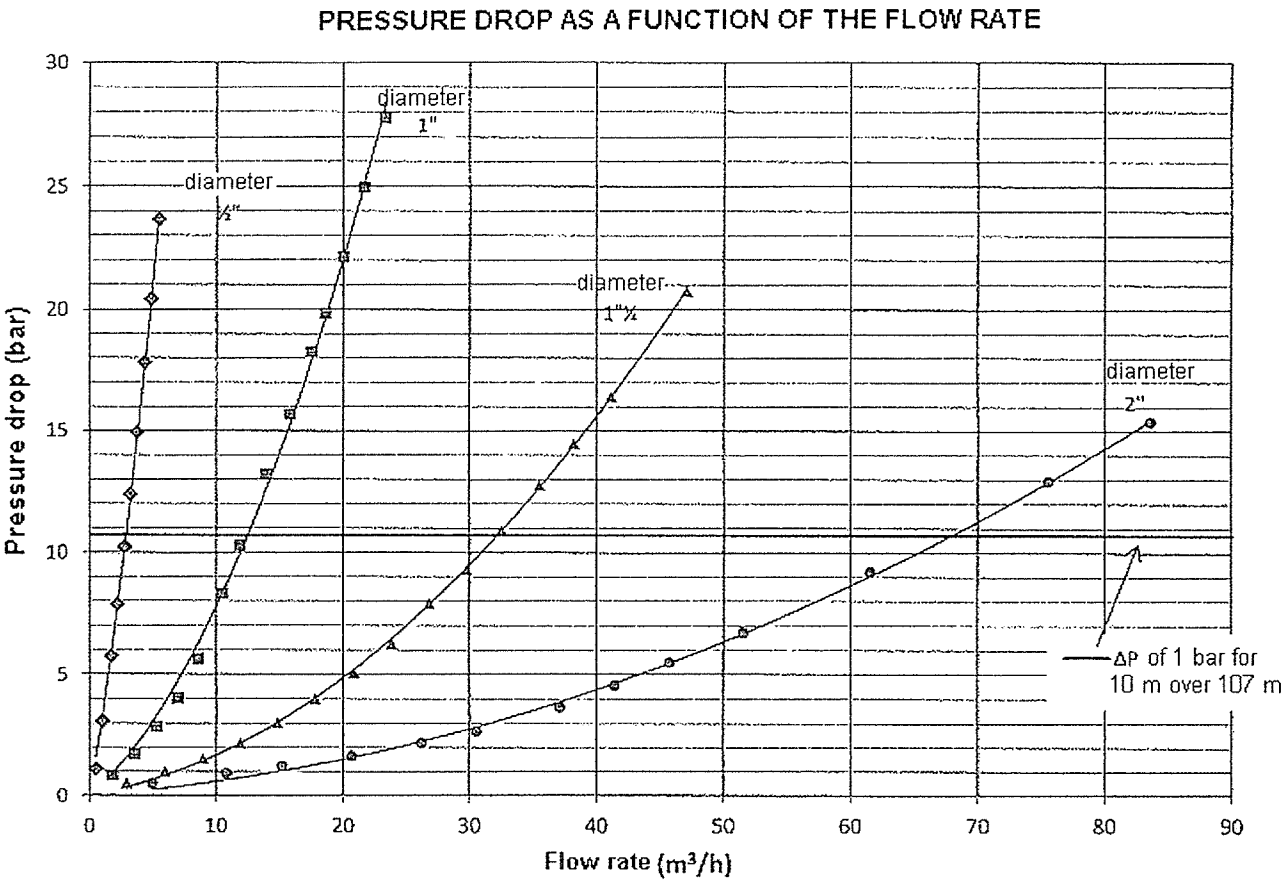
FIG. 2 is a curve representing the pressure drop as a function of the flow rate with the same polymer solution and the same tubes as in FIG. 1.
Figure 3:
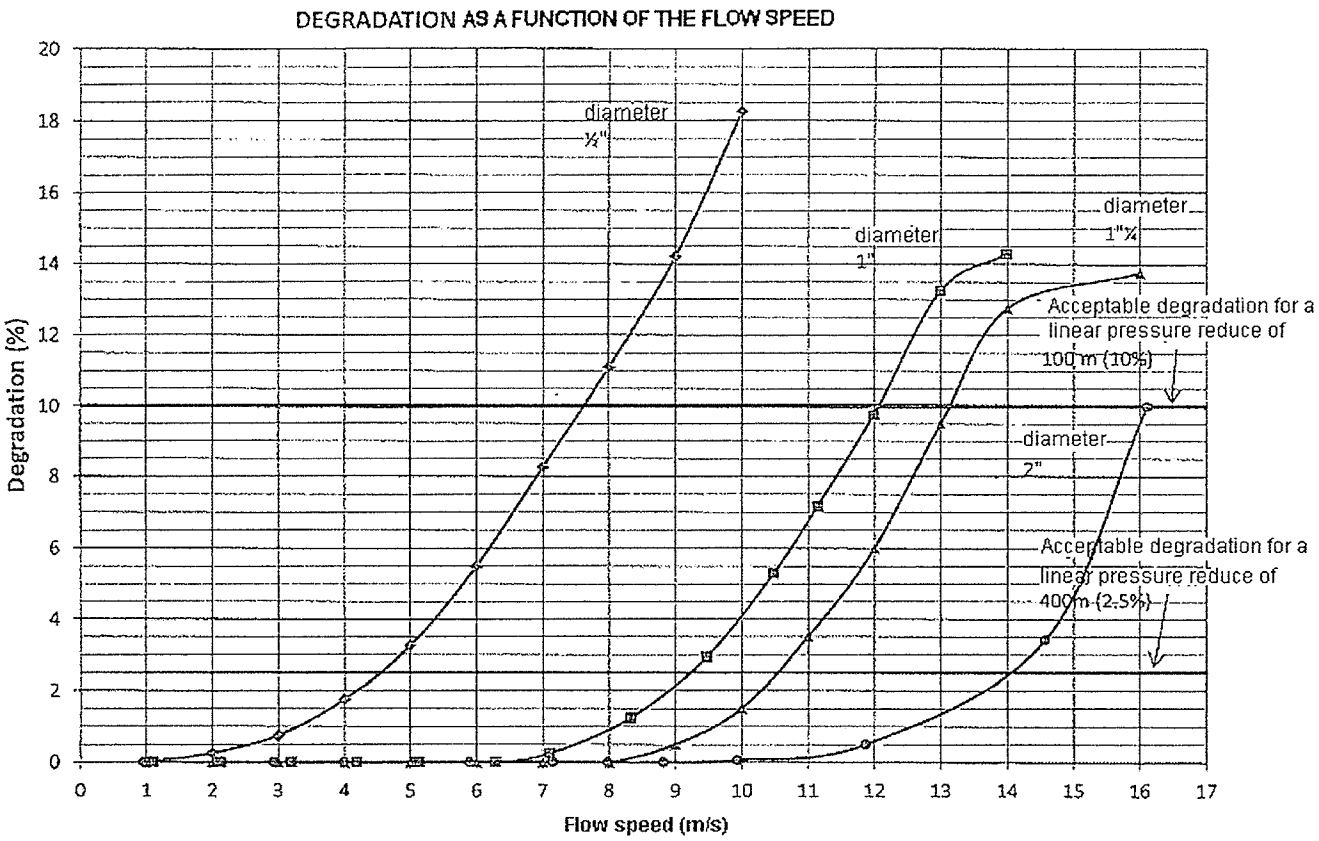
FIG. 3 is a curve representing the degradation of the polymer in percent as a function of the flow speed, with the same polymer solution and the same tubes as in FIG. 1 and a given pressure drop for this same polymer. The degradation of the polymer is directly proportional to the loss of viscosity of the polymer solution.
Figure 4:
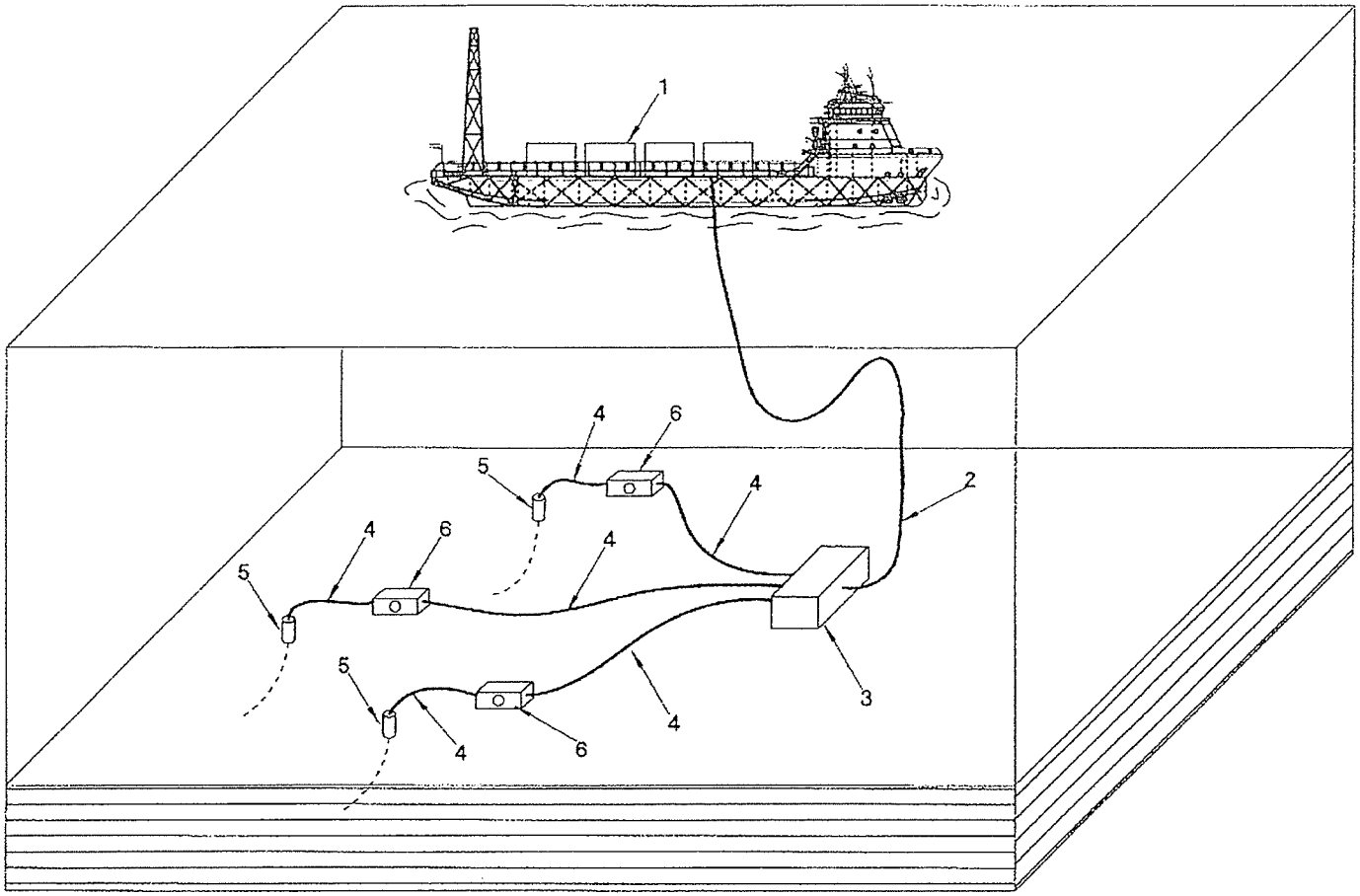
FIG. 4 represents a schematic view of a floating production, storage and offloading (FPSO) unit and the subsea injection architecture.

FIG. 4 represents a conventional offshore secondary oil recovery installation. It comprises a floating production, storage and offloading (FPSO) unit. The platform is equipped with tubes (riser) (2) into which the polymer solution is injected by means of the main injection pump. Each tube is intended to supply a manifold or distributor (3) from which as many tubes (4) as wells (5) spread out. The diameter of the tube supplying the manifold is the same as that of the tubes (4) leaving the manifold. In practice, the diameter is of the order of 10 inches. In this prior art installation, the decrease in pressure at each well (5) is obtained by installing a choke (6), in each line (4). As explained above, these chokes, by decreasing the pressure, do not present a problem for injections of water only but degrade the polymer when an aqueous polymer solution is injected.

Figure 5:
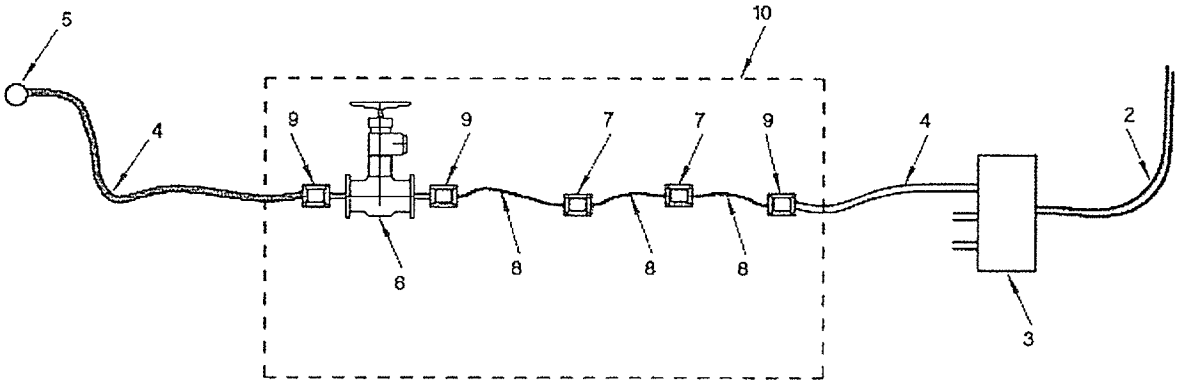
FIG. 5 represents a schematic view of the pressure control apparatus connected in series to the main line, downstream of the manifold. The apparatus consists of a linear pressure reducer having three tube sections, and a choke, everything being connected by quick couplings.

In order to overcome this drawback and as represented in FIG. 5, the invention consists in connecting a pressure reducer to each choke. The characteristics of the pressure reducer are calculated so that the choke is involved in no more than an amount of 0 to 10 bar in the decrease of the injection pressure. The device of the invention is positioned downstream of the manifold (3) on each of the tubes (4) resulting from the main line (2). In FIG. 5, the control apparatus of the invention (10) consists of the pressure reducer (7) and of the choke (6). The pressure reducer (7) itself consists, for example, of three tube sections (8) connected to one another and also to the choke (6) and to the main line (4), by means of quick couplings (9). The internal diameter of the tubes (7) is less than that of the tubes (4), in practice less than 4 inches. The chokes (6) are connected, again by a quick coupling (9) to the main injection line (4) located downstream and supplying the wells (5) with polymer solution. The internal diameter of the tube (4) between the choke (6) and the wells (5) is identical to that of the other main line portions.

Practical Example of Implementation

On an offshore oilfield, a solution of polymer having a concentration of 2000 ppm is produced from a 70/30 acrylamide/sodium acrylate copolymer emulsion having a molecular weight of 20 million and that is injected into a set of wells by means of risers, manifolds and pressure-regulating chokes. The viscosity is 200 centipoise.

The pressure of the injection pump is 115 bar and a line was chosen where the wellhead injection pressure is 77 bar. The choke and the negligible line pressure drops reduce the pressure by 38 bar.

The flow rate measured at this well is around 91 $m^3$/h and the pressure/volume has been practically stabilized for more than one year.

Ground tests were carried out in order to select the size of the linear pressure reducer tube sections needed by dissolving 2000 ppm of polymer in a brine of composition:

NaCl 15.4 g/l
$NaHCO_3$ 0.62 g/l
$CaCl_2.2H_2O$ 2.54 g/l
$MgCl_2.6H_2O$ 2.54 g/l

The tests are carried out on various flexible pipes and a 4SP-32 rubber tube having an internal diameter of 2 inches was chosen. The working pressure for simulating the injection pressure is 165 bar, with a bursting pressure of 660 bar (Phoenix-Beattie brand).

The speed of the liquid in the tube is 12.5 meters per second and the pressure drop over 100 meters (test length) is 8.3 bar. This is perfectly acceptable with respect to the objective since it is less than a pressure drop of 1 bar per 10 meter length.

It was chosen to install, in front of the choke, a total linear pressure reducer tube length of 450 meters with three 50 meter long tube sections and one 300 meter tube section, everything being assembled by quick couplings.

When the polymer solution is injected, the initial pressure at the well drops to 77 bar, due to the drag reduction effect of the polymer in order to rise back up to 79 bar. The flow rate is 93 $m^3$/hour with a completely open choke, but with a closure potential in order to increase the pressure drop in the choke by 10 bar with little degradation of the polymer. The choke is slightly closed in order to create a pressure drop of 2 bar, which makes it possible to achieve the objective of 77 bar of injection pressure.

Should the pressure drop needed vary slightly it would be easy to remotely control the opening or closing of the choke.

Should the pressure drop vary more considerably with respect to the pressure drop needed, it would then be possible to remove or add one or two short 50 meter sections that each correspond to a pressure drop of around 4 bar.

The ground tests indicated a degradation over 100 meters of LPR of 1.2%, that is to say practically zero given the accuracy of the measurement.

The objective of the installation is therefore achieved.

What is claimed is:

1. An apparatus for controlling the injection pressure of an aqueous polymer solution in a subsea oil well, said apparatus adapted to be submerged and comprising:

a pressure reducer in the form of at least one tube adapted to be inserted between two lengths of main injection line, the tube having a diameter less than that of the main line and being adapted to absorb a majority of a pressure drop;

a choke positioned immediately upstream or downstream of the pressure reducer, said choke being adapted to be regulated in order to enable a pressure control between 0 and 10 bar.

2. The apparatus as claimed in claim 1, wherein the tube of the pressure reducer comprises at least one flexible tube section.

3. The apparatus as claimed in claim 1, wherein the pressure reducer comprises one or more flexible tube sections connected end-to-end to one another and to the choke by quick couplings that allow easy attachment.

4. The apparatus as claimed in claim 2, wherein the flexible tube section comprises a rubber-textile or metalloplastic composite capable of withstanding a pressure at least equal to the pressure of the injection pump.

5. The apparatus as claimed in claim 1, wherein the pressure reducer comprises one or more rigid metallic tube sections connected end-to-end to one another and to the choke directly or by means of flexible tubes.

6. The apparatus as claimed in claim 5, wherein the metallic tube or tubes are spiral wound.

7. The apparatus as claimed in claim 1, wherein the diameter of the tube is between ½ inch and 4 inches.

8. The apparatus as claimed in claim 1, wherein the tube length is between 10 and 1000 meters.

9. A process for reducing the polymer injection pressure as a function of the pressure of the well using the apparatus of claim 1 in an offshore enhanced oil recovery process.

10. The process as claimed in claim 9, wherein the process comprises the following steps:

calculating a pressure reduction needed by subtracting a wellhead injection pressure from a pressure of a main injection pump;

determining, via ground tests, the dimensioning and nature of a constituent tube of the pressure reducer so that the pressure drop is equal to the pressure reduction needed minus that provided by the choke, this being under the conditions of injecting the aqueous polymer solution in situ;

submerging then connecting the pressure reducer to the choke and inserting the pressure control apparatus thus obtained between two submerged lengths of injection line; and injecting the aqueous polymer solution into the main line.

11. The process as claimed in claim 10, wherein the pressure control provided by the choke is between 0 and 10 bar.

12. The process as claimed in claim 11, wherein an additional tube section is added or removed by means of divers or underwater robots, in order to modify the pressure drop provided by the linear pressure reducer.

13. The process as claimed in claim 11 wherein the pressure control provided by the choke is between 3 and 5 bar.

14. An apparatus for controlling the injection pressure of an aqueous polymer solution in a subsea oil well, said apparatus adapted to be submerged and comprising:

at least one tube adapted to be inserted between two lengths of main injection line, the tube having a diameter less than that of the main line and having a length between 10 and 1000 meters, the tube being adapted to act as a pressure reducer absorbing a majority of a pressure drop across the apparatus;

a choke positioned immediately upstream or downstream of the tube, said choke being adapted to be regulated in order to enable a pressure control between 0 and 10 bar.

* * * * *